United States Patent [19]

Yamazaki et al.

[11] Patent Number: 4,626,490

[45] Date of Patent: Dec. 2, 1986

[54] ENCAPSULATED TONER

[75] Inventors: Masuo Yamazaki, Kawasaki; Katsutoshi Wakamiya, Yokohama; Toru Matsumoto, Tokyo; Ichiro Ohsaki; Toshiaki Nakahara, both of Kawasaki; Hisayuki Ushiyama, Hiratsuka, all of Japan

[73] Assignee: Canon Kabushiki Kaisha, Tokyo, Japan

[21] Appl. No.: 693,467

[22] Filed: Jan. 22, 1985

[30] Foreign Application Priority Data

Jan. 27, 1984 [JP] Japan ..... 59-13102

[51] Int. Cl.[4] ..... G03G 9/16

[52] U.S. Cl. ..... 430/138; 430/109

[58] Field of Search ..... 430/109, 107, 110, 138

[56] References Cited

U.S. PATENT DOCUMENTS 4,465,756 8/1984 Mikami et al. ..... 430/110

4,504,563 3/1985 Tanaka et al. ..... 430/109

*Primary Examiner*—John L. Goodrow

*Attorney, Agent, or Firm*—Fitzpatrick, Cella, Harper & Scinto

[57] ABSTRACT

A core material comprising a binder mixture of a long chain organic compound and an ester of a higher alcohol and a higher carboxylic acid is encapsulated with a thin shell material to give an encapsulated toner. The encapsulated toner has a uniform structure and a narrow particle size distribution and is excellent in developing and fixation characteristics, when used in electrophotography, etc.

19 Claims, 2 Drawing Figures

ENCAPSULATED TONER

BACKGROUND OF THE INVENTION

This invention relates to a capsule or encapsulated toner to be used for developing electrostatic latent images in electrophotography or electrostatic printing.

Hitherto, a large number of electrophotographic processes have been known as disclosed in U.S. Pat. No. 2,297,691, Japanese Patent Publication Nos. 23910/1967 and 24748/1968. Generally speaking, these processes comprise steps of forming electrical latent images on a photosensitive member through utilization of a photoconductive substance according to various means, developing the latent images by use of a toner, transferring the toner images on a transfer material such as paper, if desired, and fixing the images by heating, pressure or a solvent vapor to obtain a copy. The method of securing the toner onto a material on which the toner is to be fixed by pressurization is disclosed in U.S. Pat. No. 3,269,626 and Japanese Patent Publication No. 102624/1973, and it has a number of advantages, including conservation of energy, no pollution, copying without waiting time after turning on power source for copying machine, no danger of scorching of copying paper, possibility of high speed fixing and simple fixing device.

However, in such a pressure fixing method of the prior art, no satisfactory fixing characteristic could be obtained without application of a special treatment on the image bearing member and, moreover, the fixing pressure required is so high as 200 to 300 Kg/cm$^2$. Further, for the toner material for pressure fixing, soft materials have frequently been utilized, with the result that the toner is poor in pot life, liable to cause unfavorable phenomena such as coagulation between toner particles during storage and result in coalescence or further blocking, filming on the drum surface, carrier contamination, fixing roller-offset, etc. In recent years, in order to solve the problems as mentioned above, a large number of microcapsule toners have been proposed (see Japanese Laid-Open Patent Publication No. 139745/1975). However, there are still involved many problems in such microcapsule toners and their preparation methods.

For example, in the method in which core particles are previously formed and then encapsulated, granulation is frequently conducted with the aid of an emulsifier and a dispersant. However, due to the emulsifier and the dispersant employed, depending on the conditions, a large amount of emulsified core particles may be generated, or the particles once formed may coalesce again to form coarse particles and result in particles with a very wide particle size distribution. Further, when the phase separation method is employed in the encapsulation step, due to agglomeration of particles in a dispersing medium and dissolution of the core material into the dispersing medium in which the shell material is dissolved, when a poor solvent is added, microcapsule toner with coarse particle sizes may be obtained, or nonencapsulated particles consisting only of core particles may be by-produced. In some cases, particles consisting only of the shell material may also be by-produced. Even when the spraying method, for example, is employed in the encapsulation step, in which core particles once formed are dispersed in a solution of the shell material and the dispersion is discharged by means of a binary fluid nozzle or a disc atomizer to coat the surface of core particles with the shell material, the above problems can hardly be solved fundamentally. Thus, it has been desired to form microcapsules having a uniform particle size distribution with low energy consumption for granulation and at good efficiency. Further, in addition to particle size distribution, the capsule toners of the prior art fail to cover the surface of core particles completely on account of the interfacial free energy to result in formation of defective films or cause readily interfacial peel-off. For this reason, staining of a toner carrying member such as a sleeve and lowering in image density are frequently observed.

Generally speaking, the surface of a magnetic material is highly hydrophilic and a magnetic material is localized selectively on the surface of core particles during formation of core particles in an aqueous system, as is confirmed by observation with a scanning type electron microscope. As a consequence, when hard shell film is formed on the surface of core particles, no sufficiently high electrical resistance can be obtained, whereby the toner image obtained by developing can be transferred with very poor transfer efficiency and transfer irregularity can be caused. Accordingly, various attempts have been made. For example, surface treatment with a hydrophobicity modifying agent is previously applied on the magnetic material; an additional intermediate insulating layer is provided between the core particle and the shell film; and the shell film thickness relative to the core particle is set sufficiently greater. Although the electrical resistance has been increased to some extent by such an attempt, the improvement is not sufficient. Moreover, various problems are involved such that the production steps became very complicated, and also that the thickness of the shell material cannot be increased unlimitedly.

SUMMARY OF THE INVENTION

An object of the present invention is to provide an encapsulated toner, comprising a core material including a binder resin containing a long chain organic compound having a hydrocarbon chain and a long-chain carboxylic acid ester and a shell material covering the core material and a process for producing the same.

Another object of the present invention is to provide an encapsulated toner having a high electric resistance containing magnetic particles in the core.

Still another object of the present invention is to provide an encapsulated toner adapted to light pressure fixing and/or low heat fixation.

More specifically, the present invention, in one aspect thereof, provides an encapsulated toner comprising a core material and a shell material encapsulating said core material, said core material including a binder resin containing a long chain organic compound having a hydrocarbon chain and an ester compound of $R^1COOR^2$, wherein $R^1$ is alkyl group or alkenyl group of 12 to 80 carbon atoms and $R^2$ is alkyl group or alkenyl group of 10 to 40 carbon atoms, said binder resin having an acid value of less than 2.

The present invention, in another aspect, provides a process for preparing encapsulated toner, comprising: stirring a mixture of a core material and a dispersing solvent in the presence of a dispersing agent at a temperature higher than the softening point of the core material, to obtain core particles, cooling the resultant mixture, separating the cooled core particles from the mixture, and encapsulating the separated core particles with a shell of a resin material.

DETAILED DESCRIPTION OF THE INVENTION

Figure 1:
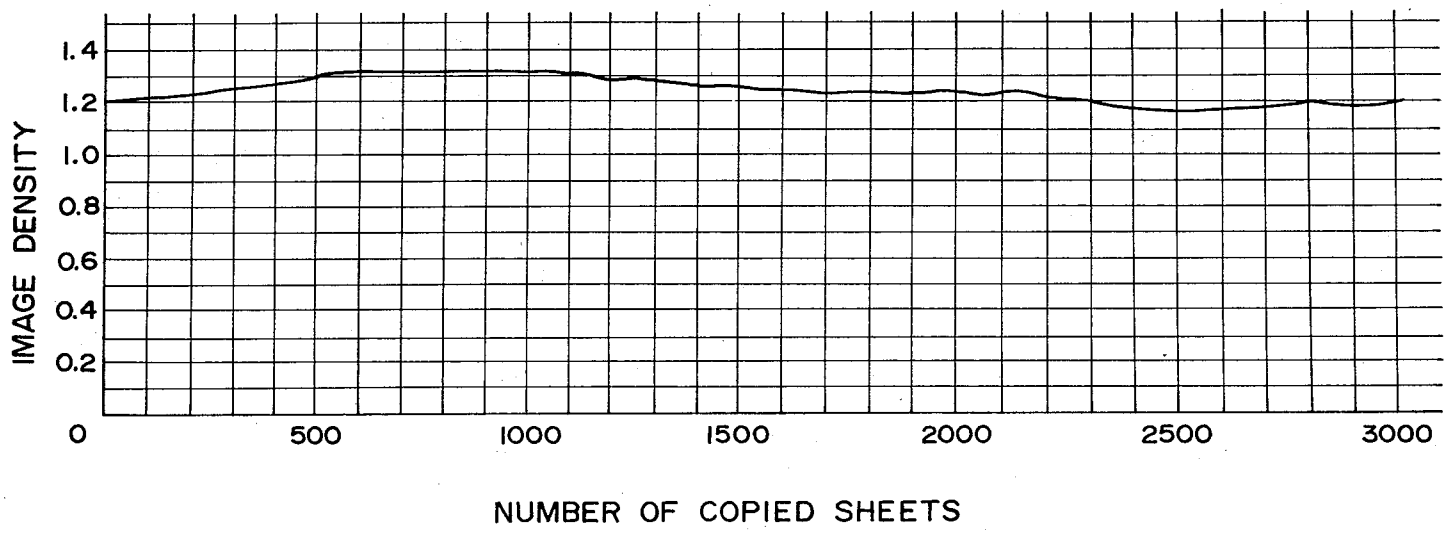
FIG. 1 shows a graph showing the relationship between number of copied sheets in successive copying and image density for the toner employed in Example 2.

The present invention provides an insulating microencapsulated toner, which comprises a core material coated with a shell material and contains a binder resin with an acid value within the range of from 0 to 2 as an essential component of the core material.

The acid value as mentioned in the present invention refers to the value measured according to the "Standard Fat and Oil Analytical Test Method 241-71" edited by the Oil Chemical Society of Japan. More specifically, one gram of sample is added to 50 cc of xylene and dissolved therein by heating to 60°–70° C. After adding 1–2 drops of phenolphthalein into the resultant homogeneous solution, an ethanolic solution of 1/10N potassium hydroxide is gradually added by use of a burette until the color is lost. The acid value is expressed in terms of milligrams of potassium hydroxide capable of neutralizing the acid radicals contained in 1 g of the sample.

The binder resin according to the present invention contains an ester compound of the formula $R^1COOR^2$, wherein $R^1$ is an alkyl group or alkenyl group of 15 to 80, preferably 16 to 40, carbon atoms and $R^2$ is an alkyl group or alkenyl group of 10 to 40, preferably 16 to 35, carbon atoms. The content of the ester compound may be 5 to 99 weight % (the total binder resin being 100 weight %).

The ester compound to be used in the present invention has a structure obtained by a dehydrocondensation reaction between a long-chain fatty carboxylic acid $R^1COOH$ and a long-chain fatty alcohol, and is a specific ester compound having two long hydrocarbon chains.

A hydrogen in the $R^1$ group can be substituted with a hydroxyl group. In this case, the ester compound is a hydroxy acid ester.

The ester compound to be used in the present invention may be obtained through various methods. As is apparent from the above explanation, the ester compound can be obtained by a dehydro-condensation reaction between a carboxylic acid and an alcohol corresponding thereto or synthesized through known processes. In this case, a mixture of various kinds of synthesized ester compounds may preferably be used as the ester compound of the present invention.

The ester compound used in the invention is similar in structure to those contained in natural waxes extracted from plants and accordingly can be obtained by treating such natural waxes so as to obtain the prescribed acid value.

Preferred natural waxes include carnauba wax, candellilla wax, and rice bran wax.

In the present invention, it is especially preferred to employ a modified carnauba wax with an acid value of 0 to 2, particularly 0 to 1, as a constituent of the core material.

Carnauba wax contains an ester of the formula $R^1COOR^2$ as the main component, and further small amounts of free acids, free alcohols, hydrocarbons, etc. When a carnauba wax with an acid value exceeding 2 is employed, the carnauba wax will be self-emulsified during disintegration into an aqueous dispersing medium in the presence of a dispersant, whereby only core particles with a very wide particle size distribution can be obtained. It is preferred to use a carnauba wax of a melt viscosity of 50 centipoises or less at around 100° C., since only a small amount of stirring power is required for disintegration of such a carnauba wax.

Further, the carnauba wax is especially preferred in the present invention because it has a very high hardness, in spite of its low melt viscosity, and therefore can form various kinds of capsule toners having any desired strength by combination with a large number of materials.

A carnauba wax having an acid value of below 2 can be obtained by modifying an ordinary commercially available carnauba wax according to methods as described below. Typical modification methods include the method in which a commercially available carnauba wax is melted by heating under reduced pressure to remove volatile matter, the method in which a polyvalent alcohol is added for esterification and the method in which the free carboxylic acid component is extracted with a solvent and an aqueous alkali solution. By treatment according to these methods, carnauba wax with acid values of less than 2 can be obtained. Examples of such carnauba wax are shown in Table I.

TABLE I

| Treating method | Alcohol extraction | After treated by melting under reduced pressure | After treated through reaction with Glycerine |
|---|---|---|---|
| Acid value | 0.8 ± 0.2 | 0.5 ± 0.4 | 0.2 ± 0.3 |
| Saponification value | 79.7 | 75.8 | 75 |
| Iodine value | 12.2 | 12 | 11 |
| m.p. (°C.) | 83.5 | 82 | 83 |

For reference, physical properties and a composition of ordinary commercially available carnauba wax before treatment are shown in the following Tables IIa and IIb, respectively.

TABLE IIa

| (Physical properties of untreated carnauba wax) | |
|---|---|
| Acid value | 2–10 |
| Saponification value | 80–90 |
| Iodine value | 5–10 |
| Melting point (°C.) | 80–85 |

TABLE IIb

| (Composition of untreated carnauba wax) | |
|---|---|
| Ester compound[1] | 80–85 wt. % |
| Free fatty acid[2] | 3–4 wt. % |
| Free alcohol[3] | 10–12 wt. % |
| Hydrocarbon[4] | below 3 wt. % |

TABLE IIb-continued

| (Composition of untreated carnauba wax) | |
|---|---|
| Others[5] | 6–9 wt. % |

Notes:
[1]Mixture of esters of $C_{14}$–$C_{35}$ fatty acids and $C_{20}$–$C_{34}$ alcohols containing about 40–55% of hydroxy acid esters.
[2]$C_{16}$–$C_{32}$ fatty acids
[3]$C_{16}$–$C_{32}$ alcohols
[4]$C_{20}$–$C_{33}$ hydrocarbons
[5]Resin and lactones In the present invention, the long chain organic compound is inclusive of $C_{12}$ or higher hydrocarbons, metal soaps, fatty alcohols, polyvalent alcohols, fatty acid metal salts, chlorides, fluorides, amides, bisamides having 12 or more carbon atoms and polymers, graft copolymers and copolymers containing the same structures in the structural units, and polyethylene, polypropylene, polydimethylaminoethyl methacrylate, styrene-dimethylaminoethyl methacrylate copolymer, etc. These are commercially available as single substances or mixture.

The long chain organic compound should preferably be one having a hydrocarbon chain with 12 or more carbon atoms.

An especially preferred class of the long chain organic compound can be obtained by graft-copolymerizing a long chain compound, preferably a long chain hydrocarbon, such as polyethylene wax or paraffin wax with an amino group-containing monomer represented by the formula:

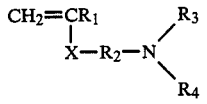

wherein:

X: a group linking a carbon of the main chain to $R_2$, such as —COO—, —CO—, —O—;

$R_2$: a lower alkylene $C_1$ to $C_5$;

$R_1$: hydrogen or a lower alkyl $C_1$ to $C_5$;

$R_3$, $R_4$: Hydrogen, a lower alkyl $C_2$ to $C_5$ or an aryl.

A preferred composition of the binder resin to be used in the present invention comprises a combination of an ester compound $R^1COOR^2$, paraffin wax and/or polyethylene wax, and wax graft-copolymerized with an amino group-containing monomer as described above.

The long chain organic compound is contained in a proportion of 1–95 wt. % in the binder resin. When a fatty acid, fatty acid ester or fatty acid metal salt is used, they must be used in a smaller amount than the ester compound $R^1COOR^2$.

The long chain organic compounds are also available as single substances or mixtures. They are generally known as lubricants, such as paraffin wax, microcrystalline wax, montan wax, ceresin wax, ozocerite wax, rice wax, shellac wax, sazol wax, metal soap, amide wax, etc.

Specific trade names and manufacturers may include Paraffin Wax (Nippon Sekiyu K.K.), Paraffin Wax (Nippon Seiro K.K.), Microwax (Nippon Sekiyu K.K.), Microcrystalline wax (Nippon Seiro K.K.), Hoechst Wax (Hoechst AG), Diamond Wax (Shinnippon Rika K.K.), Santite (Seiko Kagaku K.K.) and Panasate (Nippon Yushi K.K.).

Polyethylenes can be obtained according to the polymerization method as disclosed in, for example, Japanese Patent Publication No. 524/1965. There are further included decomposition products of such polyethylene according to the method as shown in Japanese Patent Publication No. 524/1965. Generally speaking, these are commercially available as polyethylenes for blow molding, inflation molding and injection molding and low molecular weight polyethylene or polyethylene wax, as manufactured and sold by Hoechst AG. Celanese Plastics, Philips Petroleum Co, National Petrochemicals Corp., Union Carbide Corp., British Hydrocarbon Chemicals, Ltd., Furukawa Kagaku K.K., Mitsui Sekiyu Kagaku K.K., Showa Denko K.K., Chisso K.K., etc.

Typical grades of, for example, paraffin wax may include the folowing:

Paraffin wax and Microwax (produced by Nippon Sekiyu K.K.)

| Product Name | Melting Point (°C.) |
|---|---|
| Nisseki No. 1 Candle wax | 59.7 |
| Nisseki No. 2 Candle wax | 62.0 |
| 125° Paraffin | 54.3 |
| 130° Paraffin | 56.5 |
| 135° Paraffin | 59.7 |
| 140° Paraffin | 61.9 |
| 145° Paraffin | 63.2 |
| 125° FD Paraffin | 53.8 |
| Paraffin wax (M) | 54.1 |
| 125° Special Paraffin | 54.2 |
| Nisseki Microwax 155 | 70.0 |
| Nisseki Microwax 180 | 83.6 |

Paraffin Wax (produced by Nippon Seiro)

| Trade Name | m.p. (°C.) | Name | m.p. (°C.) | Name |
|---|---|---|---|---|
| 155 | 70 | SP-0145 | 62 | NCW-5 |
| 150 | 66 | SP-1035 | 58 | NCW-10 |
| 140 | 60 | SP-1030 | 56 | NCW-35 |
| 135 | 58 | SP-3040 | 63 | NCW-38 |
| 130 | 55 | SP-3035 | 60 | NCW-40 |
| 125 | 53 | SP-3030 | 57 | NCW-42 |
| 120 | 50 | FR-0120 | 50 | NCW-45 |
| 115 | 47 | | | NCW-50 |
| | | | | NCW-55 |
| | | | | NCW-60 |
| | | | | NCW-110 |
| | | | | NCW-120 |
| | | | | NCW-125 |

Other examples are:

Hoechst Was OP (Partially saponified ester was of montanic acid, produced by Hoechst AG);

Hoechst Was E (ester was of montnic acid, produced by Hoechst AG);

Hoechst Wax GL3(partially saponified synthetic wax, produced by Hoechst AG);

Panasate S-218 (Nippon Yushi K.K.);

Spermaceti (Nippon Yushi K.K.);

Nissan Castor Wax (Nippon Yushi K.K.); and

Olimeth H (Kawaken Fine Chemical K.K.).

As the amide waxes, there may be included the following examples:

Saturated Fatty Acid Amide Type

Behenic acid amide:

Diamid (Nippon Suiso K.K.)

stearic acid amide:

Armide HT (Lion Yushi K.K.)

Amide S (Nitto Kagaku K.K.)
Amide T (Nitto Kagaku K.K.)
Diamid 200 (Nippon Suiso K.K.)
Diamid AP-1 (Nippon Suiso K.K.)
palmitic acid amide:
Neutron S-18 (Nippon Shono K.K.)
Amide P (Nitto Kagaku K.K.)
lauric acid amide:
Armide C (Lion Armor K.K.) (Nitto Kagaku K.K.)
Diamid (Nippon Suiso K.K.)

Unsaturated Fatty Acid Amide Type

Erucic acid amide:
RAM (Fine Oreanincs Inc.)
Neutron S (Nippon Shono K.K.)
LUBROL EA (I.C.L.)
Alflow-P-10 (Nippon Yushi K.K.)
Diamid L-200 (Nippon Suiso K.K.)
Blaidic acid amide
Oleic acid amide:
Armoslip CP (Lion Yushi K.K.)
Neutron (Nippon Shono K.K.)
Amide O (Nitto Kagaku K.K.)
Diamid O-200 (Nippon Suiso K.K.)
Diamid G-200 (Nippon Suiso K.K.)
Neutron E18 (Nippon Shono K.K.)
Elaidic acid amide Bisfatty Acid Amide Type Melhylenebisbehenic acid amide:
Diamid NK-bis (Nippon Suiso K.K.)
Methylenebisstearic acid amide:
Diamid 200-bis (Nippon Suiso K.K.)
Armowax (Lion Armor K.K.)
Bisamide (Nitto Kagaku K.K.)
Methylenebisoleic acid amides:
Lublon O (Nippon Suiso K.K.)
Ethylenebisstearic acid amide:
Armowax EBS (Lion Armor K.K.)
Ethylenebisoleic acid amide
Hexamethylenebisstearic acid amide:
Amide 65 (Kawaken Fine Chemical K.K.)
Hexamethylenebisoleic acid amide:
Amide 60 (Kawaken Fine Chemical K.K.)
Octamethylenebiserucic acid amide
Monoalkylol amide
N-(2-hydroxyethyl)lauric acid amide:
Tohol N 130 (Toho Kagaku K.K.)
Amizol LME
N-(2-hydroxyethyl)erucic acid amide
N-(2-hydroxyethyl)stearic acid amide:
Amizol (Kawaken Fine Chemical K.K.)
N-(2-hydroxyethyl)oleic acid amide
N-(2-hydroxymethyl)stearic acid amide:
Methylolamide (Nitto Kagaku K.K.)

Similarly as the above hydrocarbon chain compounds, it is also possible to use polymeric substances such as polyethylene wax or polyethylene. As commercially available polymeric substances, there are various grades such as AC polyethylene of Allied Chem. Co., Sunwax of Sanyo Kasei K.K., Hoechst Wax of Hoechst AG, Hiwax of Mitsui Sekiyu Kagaku K.K.), A Wax of BASF, DQOJ of NUC, ELVAX of Mitsui Polychemical K.K. and Shodex of Showa Yuka K.K. Examples of polyethylene wax are AC#1702, AC#617, AC#6, AC#7, AC#8, AC#9 and AC#615 produced by Allied Chem. Co.; Sunwax 171P, 151P, 131P, 161P and 165P produced by Sanyo Kasei K.K.; Hoechst Wax PE130, PE190 and PA520 produced by Hoechst AG; Hiwax 110P, 210P, 220P, 310P, 320P, 200P, 410P, 405P and 400P produced by Mitsui Sekiyu Kagaku K.K.; BASF A Wax and AM Wax produced by BASF. As oxidation type polyethylene, there are AC629, AC655, AC680, AC690, AC392, Sunwax E300, Hiwax 4202E, 4053E, Hoechst PAD521, PAD522, etc.

It is also possible to use other polymeric materials such as Sholex 6050, 6200, 5050, 5080, 5220, F6050V produced by Showa Yuka K.K., Hizex 1200J, 2100J, 2200J, 5100J produced by Mitsui Sekiyu Kagaku K.K., Staqulene E601, E650, E670 produced by Furukawa Kagaku K.K., Mirason UeO23H, ACe30N, FL60, FL67 produced by Mitsui Polychemical K.K., and others.

When monomers are graft copolymerized or cograft copolymerized onto the substrate of a long chain compound having a hydrocarbon chain, various kinds of methods known in the art can be used therefor. For example, it is possible to apply the bulk polymerization method, the solution graft polymerization method in which a solvent is used, the emulsion polymerization method in which polymerization is carried out in an emulsion system, and the suspension polymerization method.

When the encapsulated toner according to the present invention is used as a pressure-fixable toner, it is preferred to incorporate waxes such as polyethylene wax, oxidized polyethylene, paraffin, fatty acid, other fatty acid ester, aliphatic acid amide, aliphatic acid metal salt, higher alcohol, etc., ethylene-vinyl acetate resin, cyclized rubber and others as at least a part of the long chain organic compound.

For a heat fixable toner, it is preferred to use, in addition to the above-mentioned essential components, those materials exhibiting rubbery elasticity such as styrene-butadiene resin, or polyester resins having groups of trifunctional or more, or polymers having a three-dimensional network structure by mixing with a crosslinking monomer to provide crosslinked portions between main chains, are preferable, since they are strongly resistant against heat off-set, and, further, fixing temperature can be suppressed to a relatively low temperature simultaneously with improvement in heat-offset characteristic by incorporating an appropriate amount of a lower molecular weight component thereby to make the molecular weight distribution broader.

In particular, when core particles are prepared according to the suspension granulation method, it is preferred to combine the ester compound with a resin having amine groups.

The binder resin in the present invention should preferably have a penetration number of 15 or less, preferably 0.1 to 3. Even in pressure fixing, a rigid binder resin has better fixing characteristic than a soft binder resin with a greater penetration number. Further, an encapsulated toner employing a core comprising a rigid binder resin is more excellent in durability than that using a soft resin.

The penetration number of the binder resin is measured according to ASTM D1321-76.

For the shell material to be used in the present invention, known resins are available, as exemplified by homopolymers or copolymers synthesized from the following monomers: styrene and derivatives thereof such as p-chlorostyrene and p-dimethylaminostyrene; acrylates or methacrylates such as methyl acrylate, ethyl acrylate, butyl acrylate, methyl methacrylate, ethyl methacrylate, butyl methacrylate, N,N-dimethylaminoethyl methacrylate and the like; maleic anhydride or half-ester, half-amine or diesterimide of maleic anhydride; nitrogen-containing vinyl monomers such as vinyl pyridine, N-vinylimidazole, etc., vinyl acetals such as vinyl formal, vinyl butyral, etc.; vinyl monomers such as vinyl chloride, acrylonitrile, vinyl acetate, etc.; vinylidene monomers such as vinylidene chloride, vinylidene fluoride, etc.; olefin monomers such as ethylene, propylene, etc.; and so on. It is also possible to use polyester, polycarbonate, polysulfonate, polyamide, polyurethane, polyurea, epoxy resin, rosin, modified rosin, terpene resin, phenol resin, aliphatic or alicyclic hydrocarbon resin, aromatic petroleum resin, melamine resin, polyether resin such as polyphenyleneoxide or thioether resin, or mixtures thereof.

For the colorant to be contained in the core material of the capsule toner of the present invention, known dyes and pigments may be available. For example, there may be employed various kinds of dyes and pigments, including carbon black, aniline black, naphthol yellow, molybdenum orange, rhodamine lake, alizarine lake, methyl violet lake, phthalocyanine blue, nigrosine methylene blue, rose bengal, quinoline yellow and others.

The magnetic material to be incorporated in the core material of the capsule toner of the present invention may include ferromagnetic elements such as iron, cobalt, nickel or manganese and alloys containing these elements such as magnetite, ferrite, etc. The magnetic material may also be used as a colorant. Further, the particles of the magnetic material may be treated with various kinds of hydrophobicity modifying agents such as silane coupling agents, titanium coupling agents and surfactants. The content of the magnetic material may preferably be 15 to 70 parts by weight based on 100 parts by weight of all the resin in the core material.

In the present invention, since the ester compound is contained as a binder resin, localization or protrusion of the magnetic material (particles) on the core surface can be avoided. For this reason, the encapsulated toner of the present invention has a high electric resistance value ($10^{12}$–$10^{15}$ ohm.cm).

As optional ingredients, charge controlling agents, free-flowability imparting agents, carbon black, various dyes or pigments as colorants, hydrophobic colloidal silica, etc., can also be added to or mixed with the capsule toner of the present invention.

In the capsule toner particles of the present invention, the ratio of core to shell is preferably from 0.1 to 50 parts by weight of shell material per 100 parts by weight of core material, and it is preferred for the toner to have a form in which the core is coated with a thin shell.

The capsule toner may have an average particle size of 3 to 20μ, preferably 5 to 10μ. The toner preferably comprises a core containing 1 to 30 wt. %, preferably 5 to 15 wt. %, of a coloring dye or pigment with a coating therearound of a rigid material to a thickness of 0.01 to 2μ, preferably 0.1 to 0.5μ.

The capsule toner can be prepared according to various encapsulation techniques known in the art. For example, it is possible to use the spray drying method, the interfacial polymerization method, the coacervation method, the phase separation method, the in-situ polymerization method, the methods as disclosed in U.S. Pat. Nos. 3,338,991, 3,326,848 and 3,502,582.

The particularly preferable method to be used in the present invention comprises forming previously core particles by the spray drying method or imparting a strong shearing force in an aqueous medium in the presence of an emulsifier or/and a suspending agent, subsequently dispersing the core particles in a solution of at least one shell material in a good-solvent (having a high dissolving power for the shell material) and adding gradually a poor-solvent (having low dissolving power for the shell material) into the dispersion thereby to deposit the shell material onto the surface of core particles. When an emulsifier or a suspending agent exists on the surface of core particles, it is also possible to remove the emulsifier or/and the suspending agent once from the surface of core particles as the pre-treatment for the capsulation step, if desired.

The present invention will be further explained with reference to the following examples.

EXAMPLE 1

A commercially available carnauba wax No. 1 (acid value: 2.5, produced by Noda Wax K.K.) in an amount of 1 Kg was charged into a 2-liter four-necked flask, and the inner pressure in the vessel was reduced to 1–2 mmHg. While maintaining the reduced pressure, the vessel was internally heated to 250° C. and vacuum distillation was conducted for 8 hours while maintaining the temperature at 250° C. The thus obtained modified carnauba wax had an acid value of 0.5 and a penetration number of 1. By use of the carnauba wax, the following components were further fusion blended therewith, followed by kneading by means of an attritor at 120° C. at 200 rpm for 3 hours.

| | |
|---|---|
| Modified Carnauba wax (acid value 0.5) | 65. wt. parts |
| Paraffin wax PF155 (produced by Nippon Seiro K.K.) | 35. wt. parts |
| Magnetic material | 60 wt. parts |

The binder resin comprising the modified carbauba wax and the paraffin wax had an acid value of about 0.33 and a penetration number of 2.

On the other hand, 20 liters of water and 20 g of a water-soluble silica (Aerosil #200, produced by Nippon Aerosil K.K.) were previously sampled into a 20-liter Agihomo-mixer (produced by Tokushu Kikai Kogyo K.K.) and heated to 90° C. Into this dispersing medium was thrown 1 Kg of the above kneaded product, and granulation was carried out under the conditions of a circumferential speed of 20 m/sec. and a pass number of 6.5 times/min. for one hour. After completion of granulation, cooling was effected by use of a heat exchanger. Into this dispersion was added 50 g of sodium hydroxide, and stirring was continued for 5 hours. The resultant spherical core particles were analyzed by emission spectrophotometry, whereby no presence of residual silica was observed. Further, by means of a centrifuge, filtration and washing with water were conducted to give core particles with a number average particle size of 10.2 μm, a volume average particle size of 14.3 μm and a coefficient of variation in volume average particle size of 18.7% at a yield of 95%. The obtained core particles were dried and dispersed thoroughly as a mixture with the following composition by using again the 20-liter Agihomo-mixer.

| | |
|---|---|
| Core particles | 1 Kg |
| Styrene-dimethylaminoethyl methacrylate copolymer (St-DM copolymer, copolymerization ratio = 20:80, molecular weight = 10000) | 80 g |
| Dimethylformamide (DMF) | 4 liter |

Then, water was gradually added to the mixture to obtain a capsule toner exhibiting smooth surface without coalescence of particles as observed by a scanning electron microscope (SEM). A mixture of 100 parts of this toner with 0.5 part of fine powdery $SiO_2$ was used for image formation by means of an electrophotographic copier PC-10 (produced by Canon K.K.), from which the fixer had been removed, followed by fixing of the unfixed image by means of a metal roller under a line pressure of 10 Kg/cm. So far as fixing characteristic was concerned, sufficient fixability was exhibited even under a line pressure of 10 Kg/cm.

EXAMPLE 2

A commercially available carnauba wax (acid value: 2.5, produced by Noda Wax K.K.) in an amount of 1 Kg was charged into a 2-liter four-necked flask, and the inner pressure in the vessel was reduced to 1–2 mmHg. While maintaining the reduced pressure, the vessel was internally heated to 250° C. and the reaction was conducted for 8 hours while maintaining the temperature at 250° C. The thus obtained modified carnauba wax had an acid value of 0.5 and a penetration number of 1. By use of the carnauba wax, the following components were further fusion blended therewith, followed by kneading by means of an attritor at 120° C. at 200 rpm for 3 hours.

| | |
|---|---|
| Modified carnauba wax (acid value 0.5) | 70 wt. parts |
| St-DM copolymer (copolymerization ratio = 20:80; M.W. = 10000) | 30 wt. parts |
| Magnetic material | 60 wt. parts |

The binder resin comprising the modified carnauba wax and the St-DM copolymer had an acid value of about 0.35 and a penetration number of about 1.

On the other hand, 20 liters of water and 20 g of a water-soluble silica (Aerosil #200, produced by Nippon Aerosil K.K.) were previously sampled into a 20-liter Agihomo-mixer (produced by Tokushu Kikai Kogyo K.K.) and heated to 90° C. Into this dispersing medium was thrown 1 Kg of the above kneaded product, and granulation was carried out under the conditions of a circumferential speed of 20 m/sec. and a pass number of 6.9 times/min. for one hour. After completion of the granulation, cooling was effected by use of a heat exchanger. Into this dispersion was added 50 g of sodium hydroxide, and stirring was continued for 5 hours. The resultant spherical core particles were analyzed by emission spectrophotometry, whereby no presence of residual silica was observed. Further, by means of a centrifugal machine, filtration and washing with water were conducted to give core particles with a number average particle size of 10.2 μm, a volume average particle size of 14.3 μm and a coefficient of variation in volume average particle size of 18.7% at a yield of 95%. The thus obtained core particles were dried and dispersed thoroughly as a mixture with the following composition by using again the 2-liter Agihomo-mixer:

| | |
|---|---|
| Core particles | 1 Kg |
| St-DM copolymer | 80 g |
| Dimethylformamide (DMF) | 4 liter. |

Then, ethanol was gradually added to the mixture to obtain a capsule toner exhibiting smooth surface without coalescence of particles as observed by a scanning electron microscope (SEM). To this toner was externally added 0.5% of a silica for giving a positively chargeable toner and image formation was effected by means of an improved PC-10 copier (produced by Canon K.K.), followed by fixing of the unfixed image by means of a metal roller under a line pressure of 10 Kg/cm. The results of image density versus number of copied sheets during successive copying are shown in FIG. 1.

As for fixing characteristic, sufficient fixability was exhibited even under a line pressure of 10 Kg/cm.

EXAMPLE 3

A commercially available carnauba wax (acid value: 2.9) was subjected to extraction with alcohol by utilizing a Soxhlet extraction device. The resultant carnauba wax had an acid value of 0.8. The carnauba wax was granulated as shown in Example 2 to give core particles with a number average particle size of 10.5 μm, a volume average particle size of 14.8 μm and a coefficient of variation in volume average particle size of 20.7% at a yield of 95%. The binder resin constituting the core particle had an acid value of about 0.56 and a penetration number of about 1. The obtained core particles were dried and dispersed thoroughly as a mixture with the following composition by using again the 20-liter Agihomo-mixer:

| | |
|---|---|
| Core particles | 1 Kg |
| St-DM copolymer | 80 g |
| Dimethylformamide (DMF) | 4 liter. |

Then, water was gradually added to the mixture to obtain a capsule toner exhibiting smooth surface without coalescence of particles as observed by SEM.

To this toner was externally added 0.5% of a silica for giving a positively chargeable toner and image formation was effected by means of an improved PC-10 copier (produced by Canon K.K.), followed by fixing of the unfixed image by means of a metal roller under a line pressure of 10 Kg/cm. The results were the same as in Example 2, with an average image density of 1.2 exhibiting neither remarkable increase nor decrease up to 3000 sheets. As for fixing characteristic, sufficient fixability was exhibited even under a line pressure of 10 Kg/cm.

EXAMPLE 4

One Kg of a commercially available carnauba wax (acid value: 2.9) was sampled into a 2-liter four-necked flask and 50 g of glycerine was further added. The contents in the vessel were heated to 100° C. and the system was evacuated to 20 mmHg by means of an aspirator. After 4 hours of reaction, the above molten product was thrown into 2 liters of water. After washing thoroughly with water, the resultant carnauba wax was found to have an acid value of 0.2. The carnauba wax was further kneaded as the following mixture by means of an attritor at 120° C. at 200 rpm for 3 hours.

| | |
|---|---|
| Modified carnauba wax (acid value: 0.2) | 40 wt. parts |
| St-DM copolymer | 30 wt. parts |
| Paraffin wax (produced by Nippon Seiro K.K. PF-155) | 30 wt. parts |
| Magnetic material | 60 wt. parts |

The binder resin comprising the modified carnauba wax, St-DM copolymer and the paraffin wax had an acid value of about 0.08 and a penetration number of about 2.5.

On the other hand, 20 liters of water and 2 g of an anionic surfactant Newlex NR (produced by Nippon Yushi K.K.) were previously sampled into a 20-liter Agihomo-mixer (produced by Tokushu Kikai Kogyo K.K.) and heated to 90° C. Into this dispersing medium was thrown 1 Kg of the above kneaded product, and granulation was carried out under the conditions of a circumferential speed of 18 m/sec. and a pass number of 5 times/min. for 30 minutes. After completion of the granulation, cooling was effected by use of a heat exchanger. Further, this dispersion was passed through a mixed column of anion exchange resin and cation exchange resin to remove the surfactant. Further, by means of a centrifuge, filtration and washing with water were conducted to give core particles with a number average particle size of 9.2 μm and a coefficient of variation in volume average particle size of 25% at a yield of 95%. The obtained core particles were dried and dispersed thoroughly as a mixture with the following composition:

| | |
|---|---|
| Core particles | 1 Kg |
| St-DM copolymer | 80 g |
| Dimethylformamide (DMF) | 4 liter. |

Then, the mixture was atomized by discharging it through a spray nozzle equipped with a disc atomizer (produced by Mitsubishi Kakoki K.K.) to obtain a capsule toner exhibiting smooth surface without coalescence of particles as observed by a scanning electron microscope (SEM).

Silica for a positive toner was added externally to this toner, and the mixture was used for image formation by means of a PC-10 copier (produced by Canon K.K.), followed by fixing of the unfixed image by means of a metal roller under a line pressure of 10 Kg/cm. The results were the same as in Example 2, with an average image density of 1.2 exhibiting neither remarkable increase nor decrease up to 3000 sheets.

As for fixing characteristic, sufficient fixability was exhibited even under a line pressure of 10 Kg/cm.

EXAMPLE 5

A graft copolymer of polyethylene wax and an amino group-containing monomer was prepared in the following manner.

Into a 2-liter flask was charged 800 ml of xylene, which was heated to 70° C. in an oil bath, and then 250 g of fine powder of polyethylene wax (m.p. 120° C.) was added thereto, followed by stirring, to be dissolved therein. To the resultant solution were added 15 g of a monomer of dimethylaminoethyl methacrylate 0.1 g of dicumyl peroxide and 0.01 g of t-dodecylmercaptan. After replacement with nitrogen, polymerization reaction was carried out at 80° C. for one hour and at 130° C. for 5 hours. After completion of the reaction, the reaction product was separated by pouring into an excessive amount of methanol, washed and dried. The yield was 128.3 g.

A binder resin (acid value of 0.1, penetration number of about 1) was prepared by fusion blending 30 wt. parts of the thus obtained graft copolymer, 30 wt. parts of the modified carnauba wax (acid value 0.5) used in Example 1, 25 wt. parts of paraffin wax and 15 wt. parts of polyethylene wax. The procedure of Example 1 was repeated except that the thus obtained binder resin was used to prepare an encapsulated toner.

The thus obtained encapsulated toner was found to be excellent in developing characteristic as well as in successive copying characteristic.

EXAMPLES 6–9

The starting waxes containing ester compounds shown in Table III below was subjected to acid value-lowering treatment, whereby modified waxes of Sample Nos. 1 to 4 were prepared as shown in Table III.

TABLE III

| Sample No. | Starting wax | Treating method | Acid value | Penetration number | Content of ester compounds (wt. %) | Number of carbon atoms in $R_1$ | Number of carbon atoms in $R_2$ |
|---|---|---|---|---|---|---|---|
| 1 | Carnauba | Reduced pressure distillation | 0.3 | 1 | 85 | 14–34 | 20–34 |
| 2 | Carnauba | Esterification | 0.4 | 1 | 85 | 14–34 | 20–34 |
| 1 | Candellia | Reduced pressure distillation | 0.3 | 2 | 40 | 16–34 | 42–56 |
| 4 | Rice Bran | Reduced pressure distillation | 0.4 | 4 | 95 | 16–34 | 22–36 |

By using the above-modified waxes, four kinds of binder resins (Example Nos. 6–9) were prepared according to the compositions shown in Table IV below and four encapsulated toners were obtained in the same manner as in Example 1 except that the above four binder resins were used.

TABLE IV

| Example No. | Wax A and its amount | Wax B and its amount | Wax C and its amount | Acid value | Penetration number |
|---|---|---|---|---|---|
| 6 | Sample No. 1 30 wt. % | Paraffin wax (PF-155) 30 wt. % | Polyethylene Wax AC-6 40 wt. % | 0.3 | 2 |
| 7 | Sample No. 2 50 wt. % | Paraffin wax (PF-155) 20 wt. % | Petrolite polywax 655 30 wt. % | 0.4 | 2 |
| 8 | Sample No. 3 80 wt. % | Sample No. 1 20 wt. % | — | 0.4 | 3 |
| 9 | Sample No. 4 40 wt. % | Crystalline wax (mfd. by Nisseki K.K.) 30 wt. % | Polyethylene wax PE-130 30 wt. % | 0.4 | 5 |

COMPARATIVE EXAMPLE 1

An encapsulated toner was prepared in the same manner as in Example 1 except that the modified carnauba wax was replaced by a polyethylene wax (AC polyethylene #6, produced by Allied Chemicals Inc.; M.W.=1500, Acid value=0) containing substantially no ester compound.

The thus obtained encapsulated toner was subjected to the developing and fixing tests as in Example 1, whereas the resultant image was rough in texture, insufficient in density and insufficient also in fixability.

When the toner was subjected to a successive copying test, it failed to give an image after ten times of copying.

COMPARATIVE EXAMPLE 2

An encapsulated toner having a number average particle size of 5.7$\mu$ and a volume-average particle size of 12.7$\mu$ was obtained in the same manner as in Example 1 except that a commercially available carnauba wax (Carnauba Wax No. 1 produced by Noda Wax K.K., Acid value=3.5). The binder resin constituting the core particles had an acid value of 2.3 and resulted in an encapsulated toner having a broad particle size distribution.

When the thus obtained encapsulated toner was subjected to a developing test, the image density was low and serious fog was observed.

COMPARATIVE EXAMPLE 3

| | |
|---|---|
| Carnauba wax (acid value 10) | 10 wt. parts |
| St-DM copolymer | 30 wt. parts |
| Magnetic material | 60 wt. parts |

Figure 2:
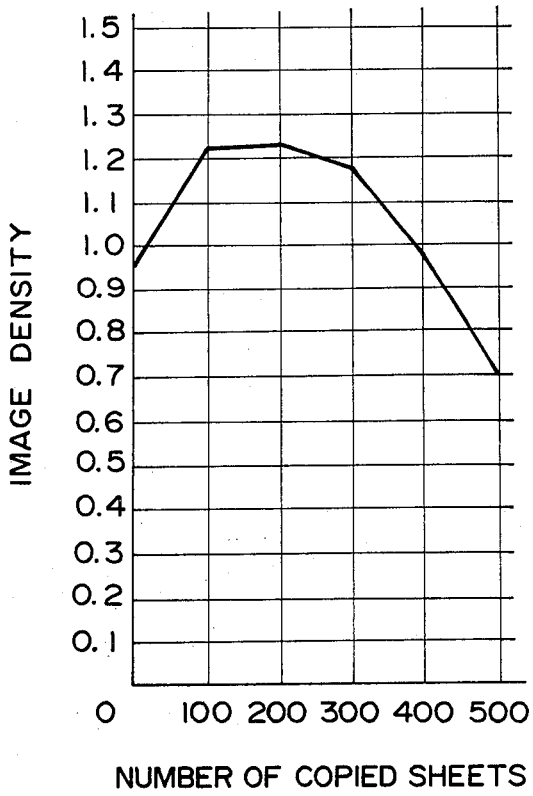
FIG. 2 shows a graph showing the relationship between number of copied sheets in successive copying and image density for the toner employed in Comparative Example 3.

The above composition was kneaded at 120° C. at 120 rpm for 3 hours by utilizing an attritor. The obtained kneaded product was granulated similarly as described in Example 1 to obtain core particles with a very wide particle size distribution, with a number average particle size of 8.4 $\mu$m, a volume average particle size of 15.5 $\mu$m and a coefficient of variation in volume average particle size of 35.8%. The core particles were further subjected to encapsulation as described in Example 2. Image formation was conducted by means of an improved PC-10 copier (produced by Canon K.K.) with the use of the obtained toner to which 0.5 wt. % of silica for positive toner was added. The unfixed image obtained was fixed by means of metal rollers under a line pressure of 10 Kg/cm. The results of image density versus number of copied sheets in successive copying are shown in FIG. 2. As apparently seen from this Figure, the image density was lowered at a small number of copied sheets.

Also, a large quantity of white powder was observed on the sleeve of the developing means.

What is claimed is:

1. An encapsulated toner comprising a core material and a shell material encapsulating said core material, said core material including binder resin containing a long chain organic compound having a hydrocarbon chain and an ester compound of $R^1COOR^2$ wherein $R^1$ is an alkyl group or alkenyl group of 15 to 80 carbon atoms and $R^2$ is an alkyl group or alkenyl group of 10 to 40 carbon atoms, said binder resin having an acid value of 0 to 2.

2. The encapsulated toner according to claim 1, in which the binder resin has an acid value of 0 to 1.

3. The encapsulated toner according to claim 1, in which the binder resin contains a modified carnauba wax.

4. The encapsulated toner according to claim 3, in which the modified carbauba wax is prepared by modifying a carnauba wax.

5. The encapsulated toner according to claim 1, in which the binder resin has a penetration number of less than 15.

6. The encapsulated toner according to claim 5, in which the binder resin has a penetration number of 0.1 to 3.

7. The encapsulated toner according to claim 1, in which the core material contains magnetic particles.

8. The encapsulated toner according to claim 1, in which the encapsulated toner comprises 100 parts by weight of the core material and 3 to 50 parts by weight of the shell material.

9. The encapsulated toner according to claim 8, in which the encapsulated toner has an average particle diameter of 3 to 20$\mu$.

10. A process for preparing an encapsulated toner, comprising:

stirring a mixture of a core material and a dispersing solvent in the presence of a dispersing agent at a temperature higher than the softening point of said core material, to obtain core particles, said core material including binder resin containing a long chain organic compound having a hydrocarbon chain and an ester compound of $R^1COOR^2$, wherein $R^1$ is an alkyl group or alkenyl group of 15 to 80 carbon atoms and $R^2$ is an alkyl group or alkenyl group of 10 to 40 carbon atoms, said binder resin having an acid value of 0 to 2, cooling the resultant mixture, separating the cooled core particles from the mixture, and encapsulating the separated core particles with a shell of resin material.

11. The encapsulated toner according to claim 1, in which the binder contains 5 to 99 weight % of the ester compound.

12. The encapsulated toner according to claim 1, in which $R^1$ is an alkyl group or alkenyl group of 16 to 40 carbon atoms.

13. The encapsulated toner according to claim 1, in which $R^2$ is an alkyl group or alkenyl group of 16 to 35 carbon atoms.

14. The encapsulated toner according to claim 1, in which the long chain organic compound is a compound selected from the group consisting of polyethylene wax, oxidized polyethylene, paraffin, fatty acid, fatty acid ester other than the ester compound, aliphatic acid amide, aliphatic acid metal salt, higher alcohol, ethylenevinyl acetate resin, cyclized rubber and mixtures thereof.

15. The encapsulated toner according to claim 1, in which the long chain organic compound is a compound obtained by graft-copolymerizing polyethylene wax or paraffin wax with an amino group-containing monomer represented by the formula:

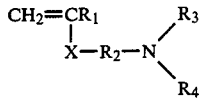

wherein: x is selected from —COO—, —CO— and —O—; $R_1$ is hydrogen or a lower alkyl from $C_1$ to $C_5$; $R_2$ is a lower alkylene from $C_1$ to $C_5$; and $R_3$ and $R_4$ are each selected from hydrogen, a lower alkyl from $C_2$ to $C_5$ and an aryl.

16. The encapsulated toner according to claim 1, in which the long chain organic compound is styrenedimethylaminoethyl methacrylate copolymer.

17. The encapsulated toner according to claim 1, in which the binder resin comprises a wax graft-copolymerized with an amino group-containing monomer and at least one compound selected from the group consisting of an ester compound, a paraffin wax and a polyethylene wax.

18. The encapsulated toner according to claim 11, in which the binder resin contains a mixture of the ester compounds.

19. The process according to claim 10, in which the dispersing solvent is an aqueous medium.

* * * * *